US010165796B2

(12) United States Patent
Gebara

(10) Patent No.: US 10,165,796 B2
(45) Date of Patent: Jan. 1, 2019

(54) HOOKAH SYSTEM

(71) Applicant: Naji Gebara, Rochester Hills, MI (US)

(72) Inventor: Naji Gebara, Rochester Hills, MI (US)

( * ) Notice: Subject to any disclaimer, the term of this patent is extended or adjusted under 35 U.S.C. 154(b) by 195 days.

(21) Appl. No.: 14/974,199

(22) Filed: Dec. 18, 2015

(65) Prior Publication Data

US 2017/0172203 A1 Jun. 22, 2017

(51) Int. Cl.
*A24F 1/30* (2006.01)
*A24F 5/00* (2006.01)
*A24F 5/04* (2006.01)

(52) U.S. Cl.
CPC . *A24F 5/00* (2013.01); *A24F 1/30* (2013.01)

(58) Field of Classification Search
CPC ..... A24F 5/00; A24F 1/30
USPC ..... 131/328
See application file for complete search history.

(56) References Cited

U.S. PATENT DOCUMENTS 41,205 A * 1/1864 Dunbar ..... F16J 9/00 92/257
2,419,509 A * 4/1947 Turner ..... A24F 1/10 131/198.1
4,782,945 A * 11/1988 Geiler ..... B65D 1/0276 206/139
5,908,031 A * 6/1999 Clark ..... A24F 1/30 131/173
2010/0126518 A1 5/2010 Saleh
2014/0326257 A1* 11/2014 Jalloul ..... A24D 1/14 131/226
2016/0143351 A1* 5/2016 Bavar ..... A24F 5/00 131/226
2016/0206001 A1* 7/2016 Eng ..... A24F 47/008
2017/0055570 A1* 3/2017 Elhalwani ..... A24F 1/30
2017/0099873 A1* 4/2017 Benjamignan ..... A24F 1/30

FOREIGN PATENT DOCUMENTS

DE 102014108525 A1 * 12/2015 ..... A24F 1/30

OTHER PUBLICATIONS

Definition of corresponding, Merriam-Webster Dictionary, https://www.merriam-webster.com/dictionary/corresponding, accessed May 22, 2018.*
Machine translation of DE 102014108525 (Year: 2015).*

* cited by examiner

*Primary Examiner* — Eric Yaary
*Assistant Examiner* — Russell E Sparks
(74) *Attorney, Agent, or Firm* — Fishman Stewart PLLC

(57) ABSTRACT

A hookah system for a smoking product may comprise a head assembly and a base assembly. The head assembly may include a capsule, a cavity member, a bowl, and a ring. The capsule may include a capsule base, a capsule sidewall with a capsule interlock, and a capsule shelf. The cavity member may include a cavity base with a shaft extending therefrom and about an axis, a cavity sidewall with a cavity interlock configured to be positioned in at least a portion of the capsule interlock, and a cavity shelf. The bowl may include a bowl sidewall and a bowl base configured to engage the shaft. The ring may be configured to be positioned between the cavity member and the bowl.

15 Claims, 13 Drawing Sheets

HOOKAH SYSTEM

BACKGROUND

Traditional hookahs, also referred to as an arguilers, narguilers, and shishas, generate smoke from burning tobacco. A user sucks from a hose to pass the smoke from the tobacco, down a tube, and into a reservoir having water and air. The smoke is passed through the water, mixes with the air, and then is inhaled by the user through a hose. Hookah smoking is a social event that brings people together to pass time while enjoying a gathering and for smoking relaxation. Typically hookah smoking lasts hours during which time users replenish the tobacco on several occasions and sometimes with different flavors.

Typical hookahs, however, are not personalized, lack features to optimize smoking, and provide no interaction with the user. There is a need for a hookah system, for example, that can be personalized, facilitates even burning of smoking products, and provides visual and audio feedback.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

A hookah system for a smoking product may comprise a head assembly and a base assembly. The base assembly may include a tray, a tube, a reservoir with a release, and a hose with a pipe. The head assembly may include a capsule with the smoking product, a cavity member, a bowl, and a ring. The capsule may include a capsule base, a capsule sidewall defining an outer periphery of the capsule base and with a capsule interlock extending therefrom, and a capsule shelf extending outwardly from the capsule sidewall. The cavity member may include a cavity base with a shaft downwardly extending therefrom and about a cavity or shaft axis, a cavity sidewall extending upwardly from the cavity base and with a cavity interlock, and a cavity shelf extending outwardly from the cavity sidewall. The cavity interlock may be configured to be positioned in at least a portion of a corresponding member, e.g., the capsule interlock. The ring may be positioned between the cavity member and the bowl. The bowl may include a bowl base with an aperture configured to engage the shaft and a bowl sidewall extending from the bowl base to engage the ring.

The hookah system may be configured for any smoking product. An exemplary smoking product may include any substance that emits smoke in response to being burned, e.g., by heat from a heat source such as charcoal placed over the smoking product. An exemplary heat source may produce heat in the range of 350 to 800 degrees Fahrenheit. The smoking product may include a hookah or shisha tobacco. The smoking product may be made from plants, e.g., tobacco from leaves of a tobacco plant. Alternatively, the smoking product may include tobacco-less substances such as a vapor electronic-liquid. Smoking products may include a mixture of various flavors such as fruit flavors. Vapor electronic-liquids may include electronic-juice flavors.

Figure 1:
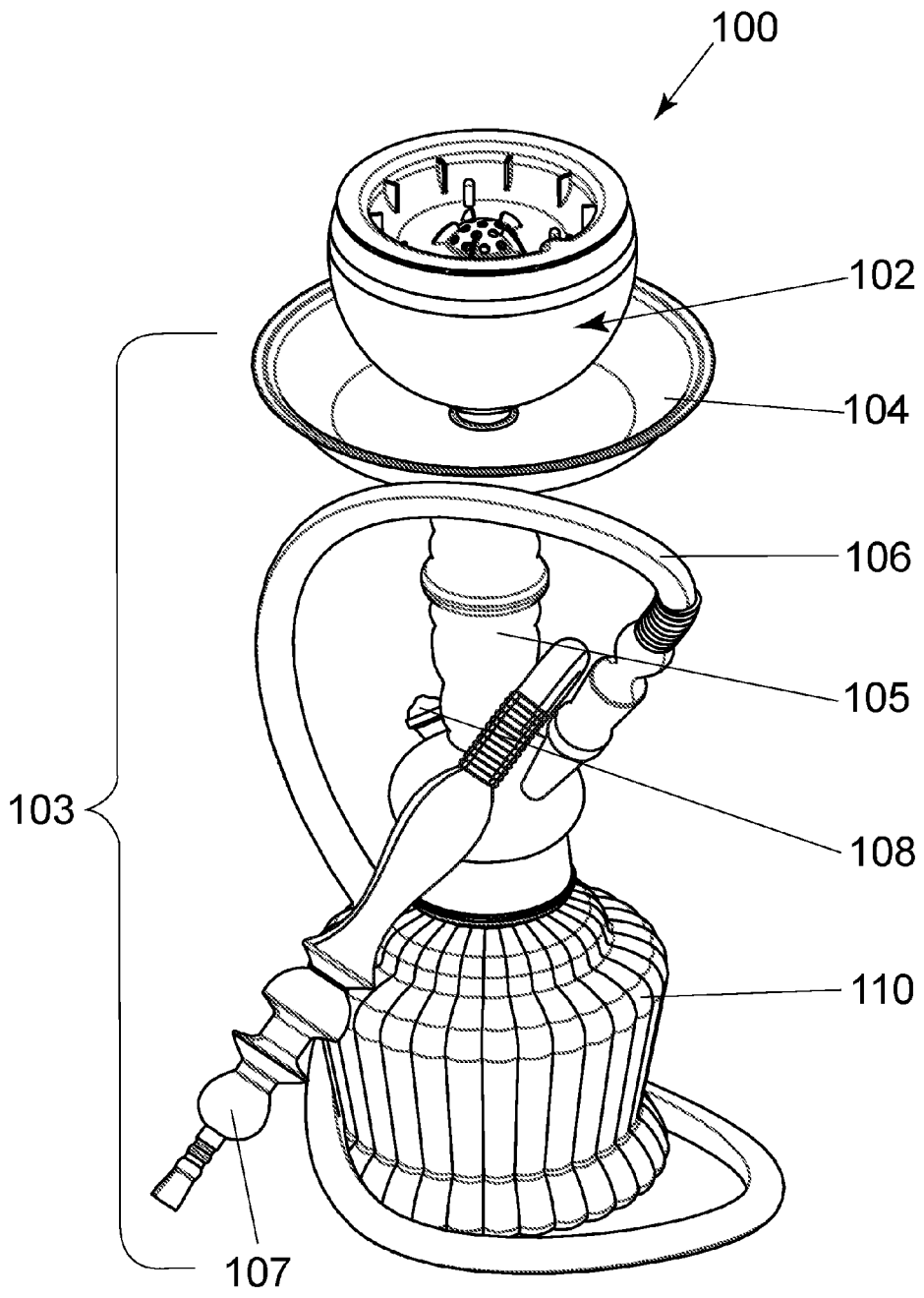
FIG. 1 illustrates an isometric view of an exemplary hookah system of the present disclosure.

FIG. 1 illustrates an exemplary hookah system 100 of the present disclosure. The system 100 may comprise a head assembly 102 and a base assembly 103. The head assembly 102 may be configured to receive and burn a smoking product. The head assembly 102 or any of its components may be of any shape or size and may be configured for use in a commercial, home or hookah lounge use. The head assembly 102 may include heat resistant, fire retardant, and water resistant materials, e.g., to prevent deterioration in response to heat and facilitate cleaning, respectively. Exemplary materials may include any material with a melt temperature over about 350 to 450° degrees Fahrenheit, e.g., a ceramic, glass, metal, or plastic. Exemplary metals may include aluminum, stainless steel, iron, tin, or a combination thereof. Exemplary plastics may include acrylics or polyethylene. The head assembly 102 may include materials or coatings to reduce cracking and breaking. The head assembly 102 may be configured to receive product branding such as logos or personalization such as engraving, e.g., the name of a manufacturer, the business such as a hookah lounge, or the user. The head assembly 102 may include various colors, shapes, and textures or any combination of transparent, semi-transparent, or reflective materials. The head assembly 102 may include lights, as described in further detail below, and may be configured to allow the light therefrom to pass through certain surfaces of the head assembly 102 and reflect from others. An exemplary transparent or semi-transparent material may include a plastic. An exemplary reflective material may include polished metal, chrome, or a mirror. The base assembly 103 may be configured to releasably receive and selectively release the head assembly 102.

The base assembly 103 may include a tray 104, a tube 105, a hose 106, a pipe 107, a release 108, and a reservoir 110. The tray 104 may be configured as a disk, e.g., to catch ash from the heat source and smoking product as it burns. The tube 105 may include a passage fluidly connecting the head assembly 102 and the reservoir 110 that is filled with water and air. The tube 105 may extend from the base assembly 103 to the water in the reservoir 110. The hose 106 is connected to the reservoir 110 to pass smoke from the reservoir 110 to the user while the user sucks from the hose 106 using the pipe 107. The release 108 may include a smoke release, e.g., to clear stagnant smoke from the reservoir 110. Thus, the system 100 may be configured to pass smoke from a heated smoking product through the tube 105, through water in the reservoir 110, and then to the user through the pipe 107.

Figure 2:
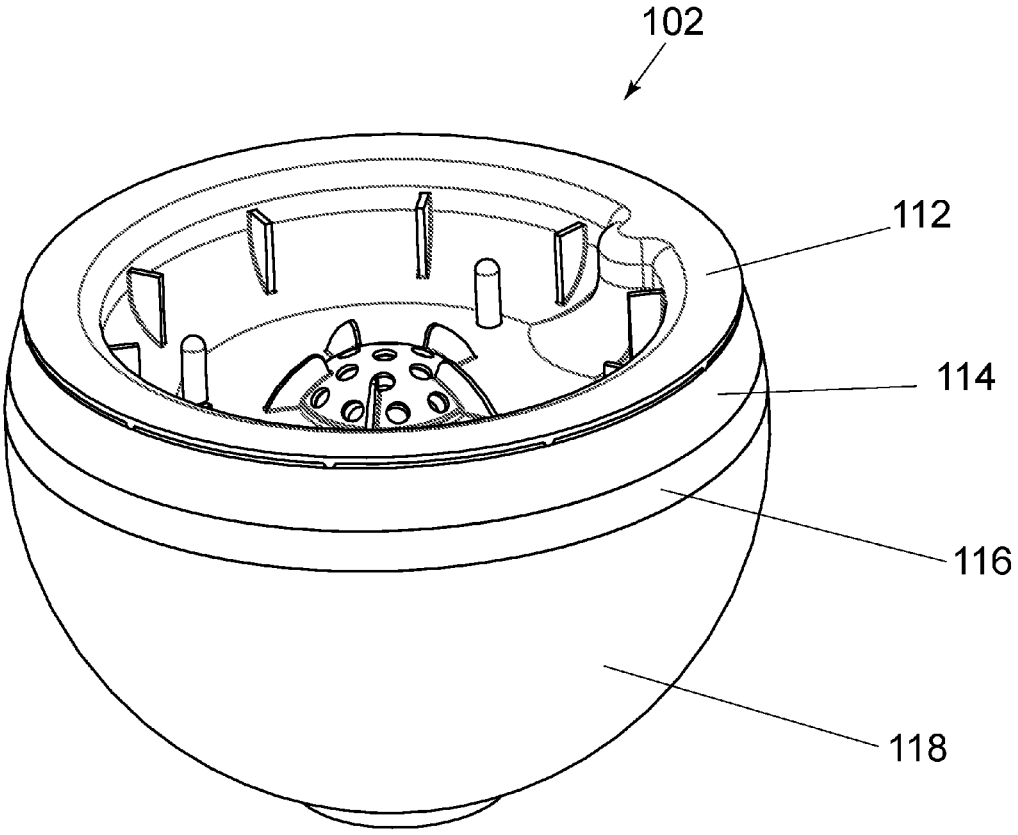
FIG. 2 illustrates an isometric view of an exemplary head assembly of the present disclosure.
Figure 3:
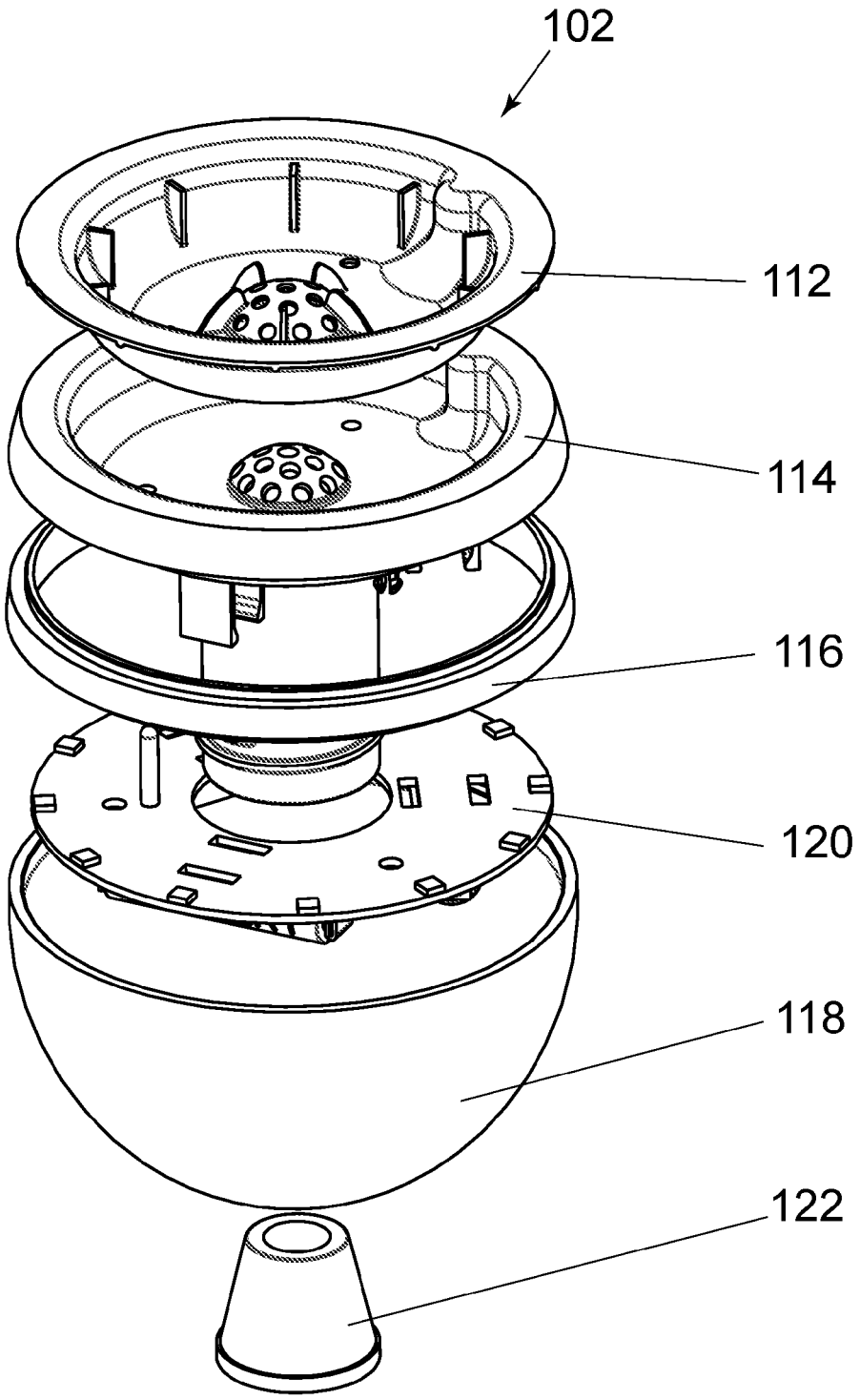
FIG. 3 illustrates an exploded view of the head assembly of FIG. 2.
Figure 4:
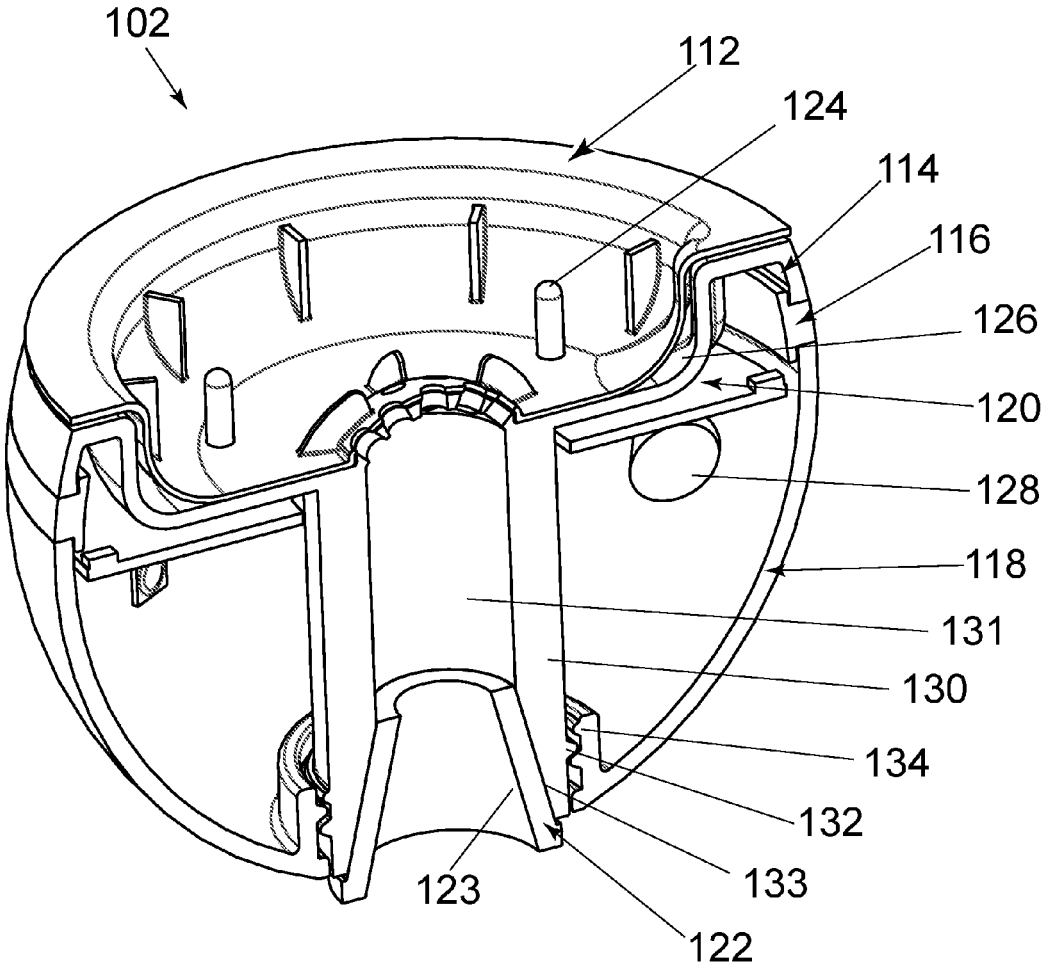
FIG. 4 illustrates a cross-section view of the head assembly of FIG. 2.

FIGS. 2-4 illustrate an exemplary head assembly 102. The head assembly 102 may be configured to attach to the base assembly 103, e.g., to provide a fluid connection thereby facilitating airflow therebetween. As shown assembled in FIG. 2, the head assembly 102 may be removable from the base assembly 103, e.g., to facilitate replacement of the smoking product. The head assembly 102 may include a capsule 112 with the smoking product (not shown), a cavity member 114, a ring 116, and a bowl 118. As shown exploded in FIG. 3, the head assembly 102 may further include an electronic based (e.g., circuit) board assembly 120, as discussed in further detail below, and a seal 122 to fluidly seal the head assembly 102 to the base assembly 103. Thus, smoke may be burned in the capsule 112 and passed through the cavity member 114, bowl 118, and seal 122, and to the user through the base assembly 103.

Referring to FIG. 4, the capsule 112 may be configured to be positioned on and at least partially in the cavity member 114. The cavity member 114 may include a shaft 130 extending downwardly from a lower surface of the cavity member 114 and about a cavity or shaft axis. The shaft 130 may include a passage 131 from an upper portion of the shaft 130 to a shaft base 132 of the shaft 130. The shaft base 132 of the shaft 130 may be configured to fit through a central passage of the ring 116 and a central passage of the board assembly 120. An outer surface of the shaft base 132 may be configured to engage an inner surface of an aperture in a bowl base 134 of the bowl 118, e.g., providing a threaded connection therebetween. The ring 116 may include upper and lower surfaces configured to respectively engage a lower surface of the cavity member 114 and an upper surface of the bowl 118. The bowl 118 may include an upper surface configured to engage the ring 116. Alternatively, the upper surface of the bowl 118 may engage the lower surface of the cavity member 114 without a ring 116. The seal 122 may include an upper end and a lower end with a tapered passage 123 therethrough. The tapered passage 123 may be configured to seal against an upper surface of the tube 105 of the base assembly 103. The tapered passage 123 of the seal 122 may be configured to radially constrain the head assembly 102 relative to the tube 105 of the base assembly 103 while allowing smoke to pass into the base assembly 103. The tapered passage 123 may also be configured to allow movement in an axial direction to facilitate removal of the head assembly 102 to replenish the smoking product or power source, as discussed in further detail below. Thus, smoke may be burned in the capsule 112 and passed through the cavity member 114, bowl 118, and seal 122, and to the user through the base assembly 103.

The board assembly 120 may include a power source 128 configured to power the board assembly 120. An exemplary power source 128 may include a battery. The battery may be rechargeable or disposable. In an exemplary approach, the power source 128 may be in the head assembly 102. This may facilitate replacement or recharging of the power source 128, e.g., during exchange or removal of the head assembly 102.

The head assembly 102 may include one or more sensors 124. The sensors 124 may include a base portion in operational communication with the board assembly 120 and a sensing portion configured to extend through the cavity member 114 and into the capsule 112. The sensors 124 may be configured to measure capsule and environmental parameters, as described in further detail below.

The head assembly 102 may further include a gap 126. The gap 126 may be defined between a lower surface of capsule 112 and an upper surface of cavity member 114. The gap 126 may be configured to provide airflow between the capsule 112 and the cavity member 114, e.g., to cool the capsule 112. The gap 126 may span from an outer periphery of the cavity member 114 or capsule 112 to a contact region between the cavity member 114 and capsule 112.

The components of the head assembly 102 may be positioned relative to each other by any type of connection. The connection may include a threaded connection as mentioned above, e.g., with external threads on the shaft base 132 of shaft 130 and internal threads on the bowl base 134 of bowl 118. The connection may include also a conical connection 133, e.g., between seal 122 and shaft 130. The conical connection 133 may guide the seal 122 into the passage 131 of shaft 130. The conical connection 133 may be configured to radially constrain the shaft 130 by the contact between the seal 122 and shaft 130 while allowing movement along the axis of the shaft 130, e.g., to allow removal of the head assembly 102 from the base assembly 103. The connection may be a releasable connection such as a contact fit, an interference fit, a snap fit, or a press fit connection. Alternatively, the connection may be permanent, e.g., by use of an adhesive with the threaded or conical connection.

Figure 5A:
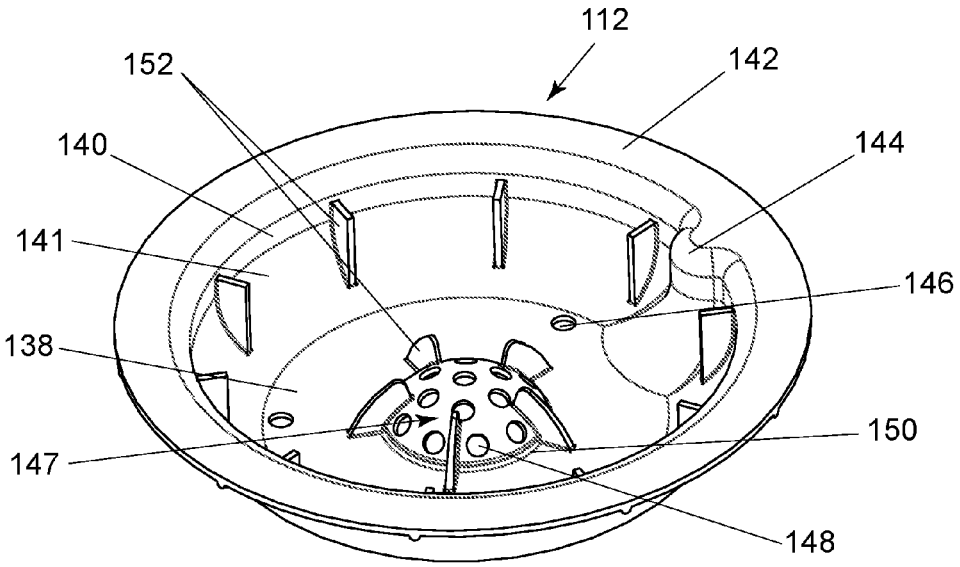
FIG. 5A illustrates an isometric view of an exemplary capsule of the present disclosure.
Figure 5B:
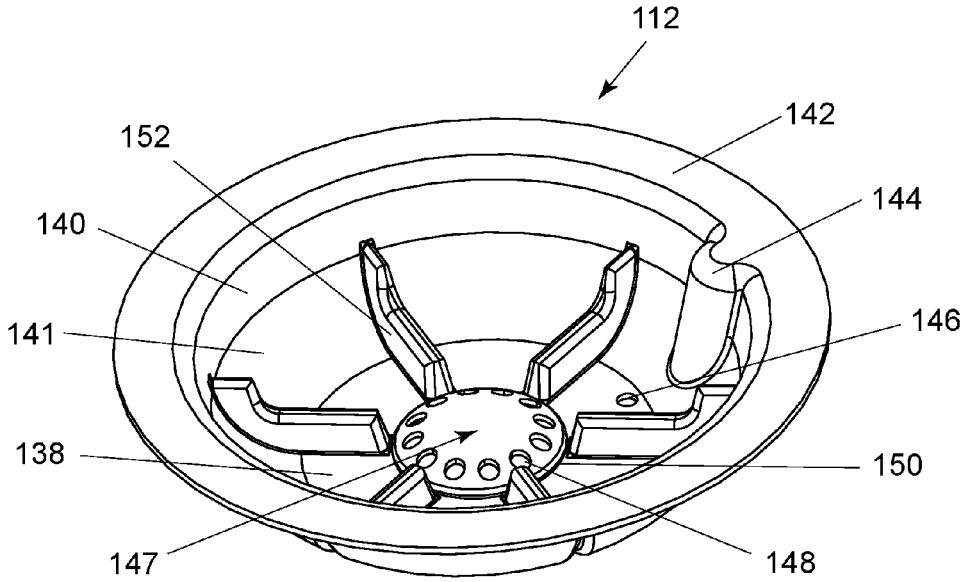
FIG. 5B illustrates an isometric view of an alternative exemplary capsule of the present disclosure.

FIGS. 5A-B illustrate an exemplary capsule 112. The capsule 112 may include a capsule base 138, a capsule sidewall 140, and a capsule shelf 142. The capsule base 138 may include upper and lower surfaces terminating at an outer periphery, e.g., defined about a capsule axis. The lower surface of the capsule base 138 may be configured to engage one or more surfaces of the cavity member 114. The capsule sidewall 140 may extend outwardly from the outer periphery of the capsule base 138 to the capsule shelf 142. The capsule sidewall 140 may include an angled or curved portion 141, e.g., to facilitate airflow between a lower surface of the capsule 112 and an upper surface of the cavity member 114. The capsule sidewall 140 may include the capsule interlock 144 protruding inwardly (as shown) or outwardly therefrom. The capsule shelf 142 may extend outwardly from an outer periphery of the capsule sidewall 140. The capsule 112 may be made of a capsule material, e.g., a metal such as aluminum, that allows the transfer of heat to the smoking product while resisting degradation of the capsule 112. The capsule 112 may be configured to be disposable for single use or reusable after replenishment of the smoking product. The capsule 112 may be configured to universally fit all hookahs or may have a customized fit for a particular brand or style of hookah.

The capsule 112 may include features to optimize control over the burning of smoking products. The capsule base 138 may be configured to hold the smoking product while the capsule sidewall 140 is configured to retain the smoking product on the capsule base 138. As discussed in further detail below, the capsule 112 may include a foil cover connected to the capsule shelf 142 and positioned over the smoking products thereby holding the smoking products in the capsule base 138. The capsule shelf 142 may also be configured as a holding surface for the heat source, e.g., to reduce the heat applied to the smoking product. As such, the heat source may be moved over the capsule base 138 to increase the heat applied to the smoking product or moved to the capsule shelf 142 to decrease the heat applied to the smoking product. The capsule may thus be configured for selective positioning of the heat source, thereby reducing overheating or unwanted burning of the smoking product.

The capsule 112 may include a capsule interlock 144. The interlock 144 may extend inwardly (as shown) or outwardly from the capsule sidewall 140. The capsule interlock 144 may be configured to receive a corresponding member, e.g., a cavity interlock of cavity member 114, as discussed in further detail below.

Furthermore, the capsule 112 may include one or more apertures 146. The apertures 146 may be configured to receive a respective one or more sensors 124 therethrough. The apertures 146 may be configured to facilitate the positioning of the sensors 124 into the capsule 112.

The capsule 112 may also include a capsule dome 147. The capsule dome 147 may be configured to retain smoking products while allowing airflow to the cavity member 114. The capsule dome 147 may extend upwardly from an upper surface of the capsule base 138. The capsule dome 147 may include capsule dome holes 148 to allow passage of smoke therethrough and to the cavity member 114. The capsule dome 147 may include a lower surface configured to engage an upper surface of the cavity member 114. The capsule dome holes 148 may be configured to fluidly connect with the cavity member 114 and to optimize airflow thereto, e.g., by aligning the capsule dome holes 148 with dome holes of the cavity member 114, as discussed in further detail below.

A lip 150 may extend upwardly from the capsule base 138. The lip 150 may be configured to be raised above the capsule base 138. This may limit the passage of liquid moisture from the smoking product into the capsule dome 147.

The capsule 112 may include one or more internal breakers 152 that may be positioned in a radial direction with about the capsule axis. As shown in FIG. 5A, the internal breakers 152 may be positioned below the capsule shelf 142 on the capsule sidewall 140, extend radially and inwardly from the capsule sidewall 140 and along the angled or curved portion 141, and terminate axially before (as shown) or on the capsule base 138. As also shown in FIG. 5A, the internal breakers to may be positioned along the capsule base 138 and extend radially and inwardly from the capsule base 138 to and over the lip 150 and along the capsule dome 147. As shown in FIG. 5B, the internal breakers may be positioned on the capsule sidewall 140 and extend radially and inwardly from the capsules sidewall 140, along the angled or curved portion 141, along the capsule base 138, and terminate axially before (as shown), against, or on the capsule dome 147. The internal breakers 152 may be configured to break apart and distribute the smoking product along the capsule base. The internal breakers 152 may be configured to spread and fluff the smoking product in response to shaking the capsule 112, e.g., to facilitate even burning of the smoking product. The capsule 112 may also include one or more walls or compartments (not shown) extending radially from the capsule axis to hold different types of smoking products, e.g., having different flavors.

Figure 6:
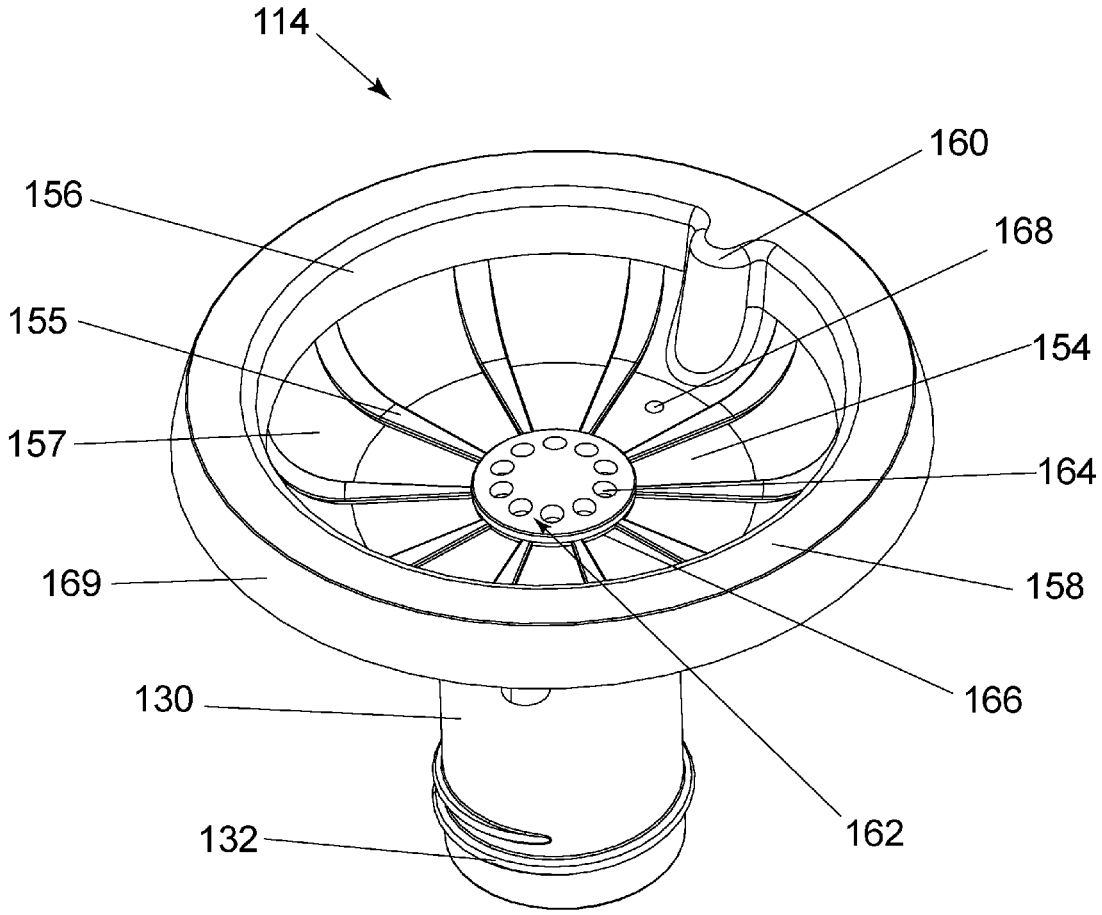
FIG. 6 illustrates a top isometric view of an exemplary cavity member of the present disclosure.
Figure 7:
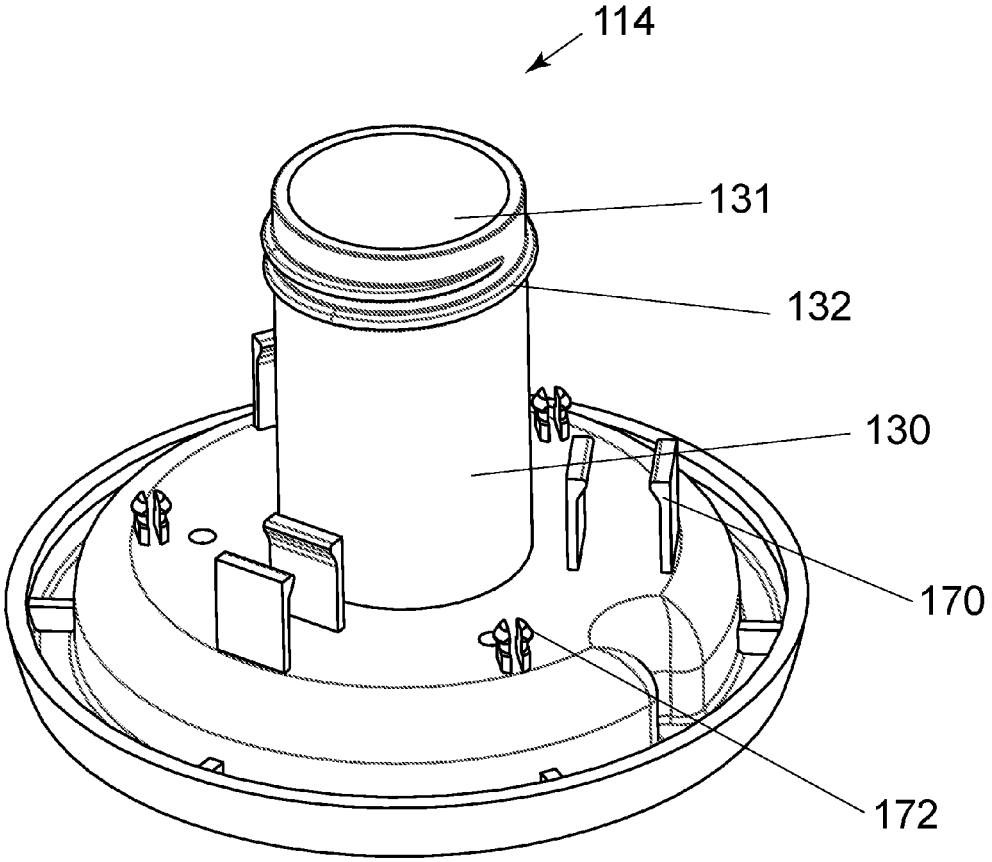
FIG. 7 illustrates a bottom isometric view of the cavity member of FIG. 6.

FIGS. 6-7 illustrate an exemplary cavity member 114. As shown in FIG. 6, the cavity member 114 may include a shaft 130, a cavity base 154, one or more protrusions 155, a cavity sidewall 156, a cavity shelf 158, a cavity interlock 160, and a cavity dome 162 with cavity dome holes 164, a lip 166, one or more apertures 168, rim 169, one or more power source holders 170, and one or more board holders 172. The cavity member 114 may include upper and lower surfaces about a shaft or cavity axis and terminating at an outer periphery. The upper surface of the cavity member 114 may be configured to engage one or more features of the capsule 112. The cavity base 154 may include one or more protrusions 155 extending radially from the cavity axis, along the cavity base 154, and to the cavity sidewall 156 and may be configured to support the capsule base 138. The cavity sidewall 156 may be configured to retain the capsule sidewall 140. The cavity sidewall 156 may define the outer periphery of the cavity base 154 and may include an angled or curved portion 157 having the protrusions 155, e.g., to facilitate airflow between a lower surface of the capsule 112 and an upper surface of the cavity member 114. The cavity shelf 158 may extend outward from the cavity sidewall 156 and may include an upper surface configured to support a lower surface of the capsule shelf 142. The cavity member 114 may include a cavity interlock 160 extending inwardly (as shown) or outwardly from the cavity sidewall 156 and may be configured to be positioned in at least a portion of a corresponding member, e.g., the capsule interlock 144 of the capsule 112. The cavity dome 162 may extend upwardly from the cavity base 154 and may include cavity dome holes 164 configured to allow the passage of smoke therethrough and into the shaft 130. The cavity dome 162 may be configured to engage capsule dome 147. The cavity dome holes 164 may be configured to align with and allow passage of smoke to the capsule dome holes 148. The lip 166 may extend upwardly from the cavity base 154 and may be configured to seal against a lower surface of the capsule 112.

Referring to FIG. 7, the cavity member 114 may be configured to engage other components of the head assembly 102. The shaft 130 may include a passage 131 to pass smoke to the base assembly 103 and may include a shaft base 132 with external threads to engage with the bowl 118. The cavity member 114 may include one or more power source holders 170 extending from a lower surface of the cavity member 114 to receive and hold respective power sources 128. The cavity member 114 may also include one or more board holders 172 extending from a lower surface of the cavity member 114 and configured to be positioned into or against the board assembly 120, e.g., to secure the board assembly 120 relative to the cavity member 114. The board holders 172 may include one or more snap fit connectors (as shown) to be received and snapped into respective apertures 188 of the board assembly 120. Alternatively, the board holders 172 may include one or more fastener connectors having internal threads to receive fasteners such as screws positioned through the respective apertures 188 of the board assembly 120. The rim 169 may extend from the cavity shelf 158 and may be configured to engage an upper surface of the ring 116 or the bowl 118.

Figure 8:
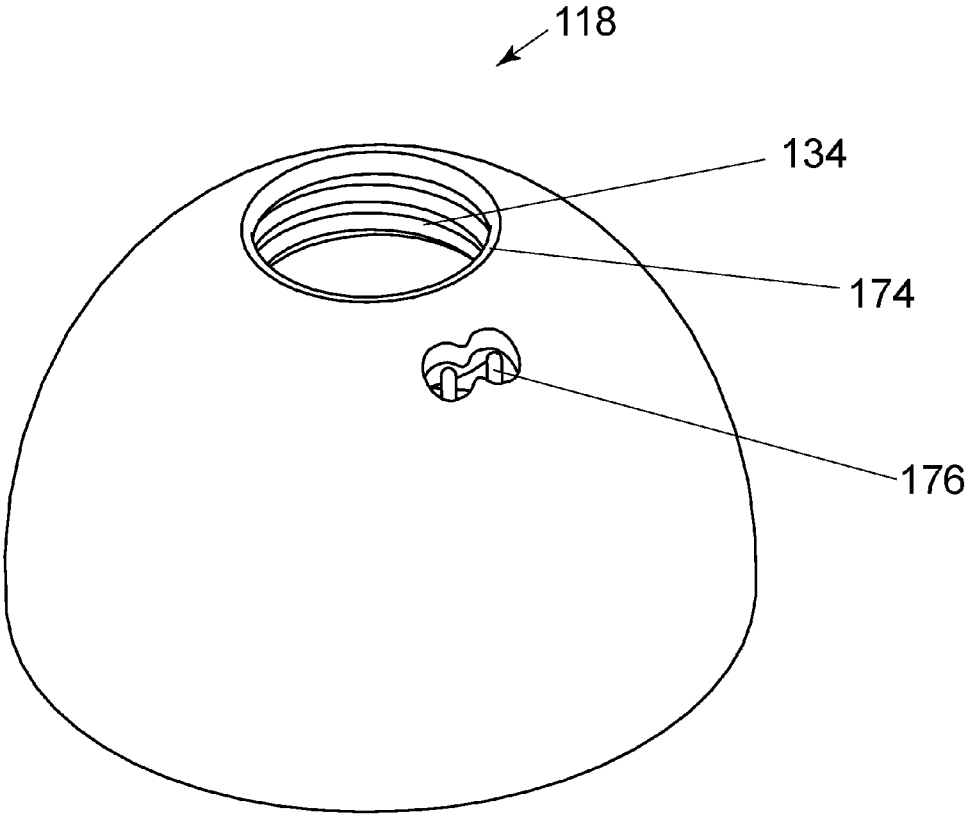
FIG. 8 illustrates an isometric view of an exemplary bowl of the present disclosure.

FIG. 8 illustrates an exemplary bowl 118. The bowl 118 may include a bowl base 134 with an aperture therethrough and a bowl sidewall extending therefrom. The aperture of the bowl 118 may include bowl base 134 with internal threads to engage external threads of shaft 130. Alternatively, the bowl 118 may include a contact fit, an interference fit, a snap fit or press fit connection with shaft 130. The bowl 118 may include stop lip 174, e.g., to provide a seal relative to the shaft base 132. The bowl 118 may also include one or more holes 176 with pins to engage a charger or charging station to charge the power source 128.

Figure 9:
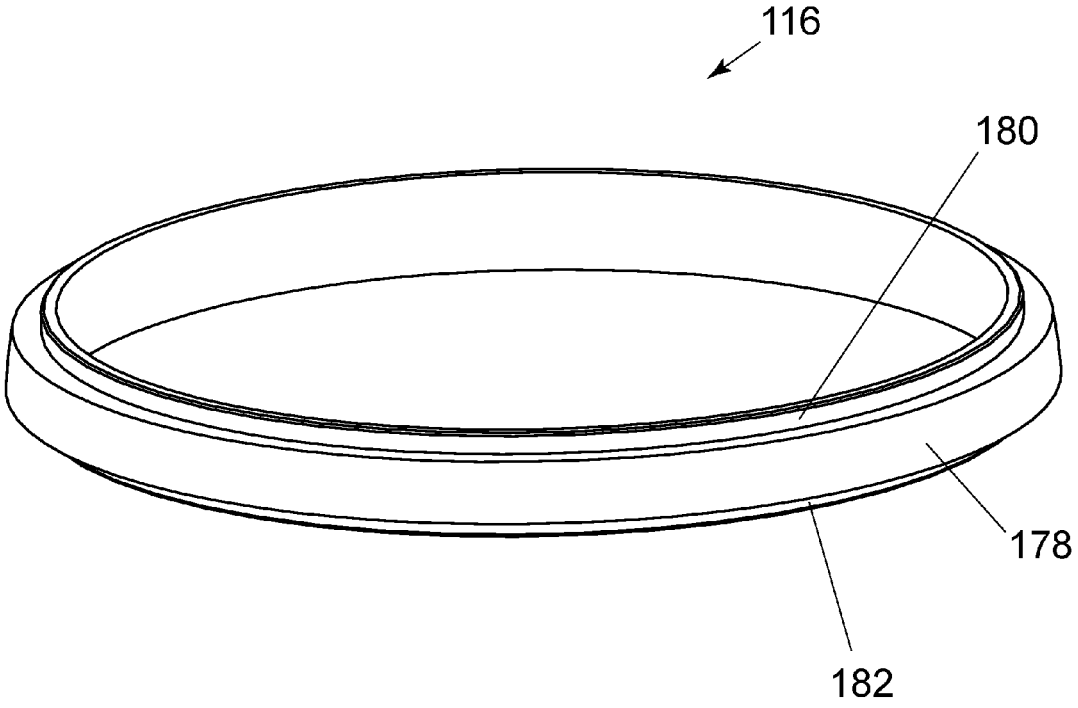
FIG. 9 illustrates an isometric view of an exemplary ring of the present disclosure.

FIG. 9 illustrates an exemplary ring 116. The ring 116 may include an upper surface with an upwardly extending rib 180, a lower surface with a downwardly extending rib 182, and a sidewall 178 therebetween. The rib 180 may be configured to engage and retain the cavity member 114. The rib 182 may be configured to engage and retain the bowl 118. Alternatively, or in addition, the ribs 180, 182 may be configured for a contact fit, an interference fit, a snap fit or a press fit.

Figure 10:
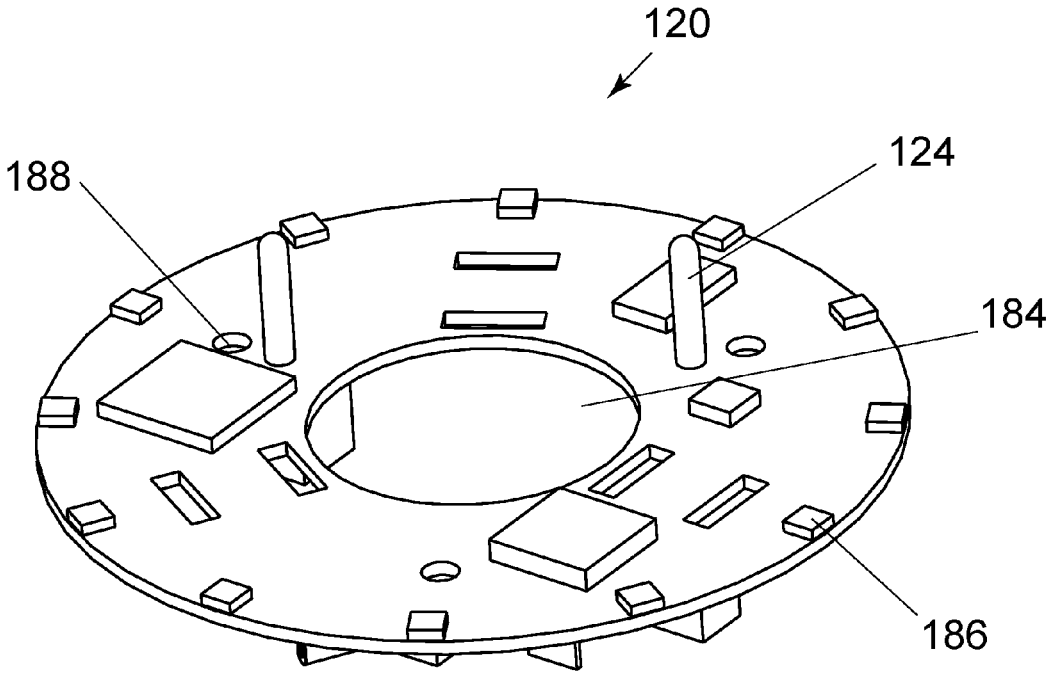
FIG. 10 illustrates an isometric view of a board assembly of the present disclosure.

FIG. 10 illustrates an exemplary board assembly 120. The board assembly 120 may include, for example, a printed circuit board (PCB). The board assembly 120 may include an aperture 184 and one or more apertures 188. The aperture 184 may be in a central area of the board assembly 120, e.g., for the shaft 130 to be positioned therethrough. The apertures 188 may be configured to receive the board holders 172 of cavity member 114, e.g., to secure the board assembly 120 relative to the cavity member 114.

The board assembly 120 may also include and may be in operational communication with one or more sensors 124, one or more lights 186, and one or more speakers (not shown), which may be operationally powered by the power source 128. The lights 186 may be positioned circumferentially about the board assembly 120 (as shown) or on an inner or outer surface of the cavity member 114, shaft 130, ring 116, or bowl 118. The one or more lights 186 may include light emitting diodes (LEDs). The lights 186 may be configured to emit light through transparent or semi-transparent portions of the head assembly 102, e.g., the ring 116 or bowl 118, or to emit light that is reflected from reflective portions of the head assembly 102. The speakers may be positioned on the board assembly 120, cavity member 114, or bowl 118.

The board assembly 120 may be configured to provide visual and audio feedback in response to capsule identification, capsule parameters, and environmental parameters. Board assembly 120 may include a radiofrequency identification sensor (RFID) (not shown) that is configured to detect an RFID tag of the capsule 112 and in response activate one or more sensors 124. The sensors 124 may be configured to measure capsule parameters in the capsule 112 such as heat, temperature, pressure, oxygen or carbon dioxide level, noise, vibration, puff rate, puff duration, and capsule end-of-life. The sensors 124 may also be configured to measure one or more environmental parameters around capsule 112 or system 100 such as light, sound, vibration, and music. As such, the board assembly 120 may be configured to emit light and sounds in response to capsule parameters, environmental parameters, or a combination thereof.

Figure 11:
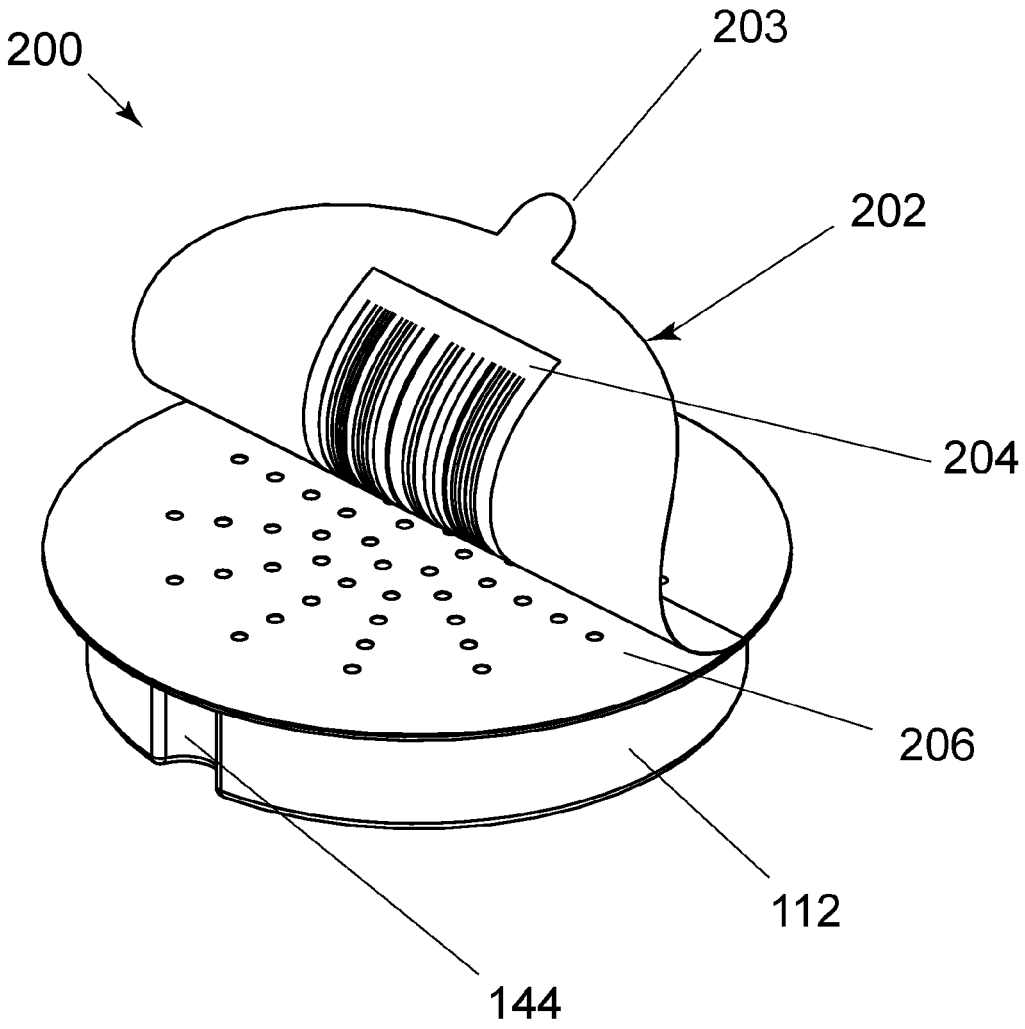
FIG. 11 illustrates a top isometric view of a capsule assembly of the present disclosure.
Figure 12:
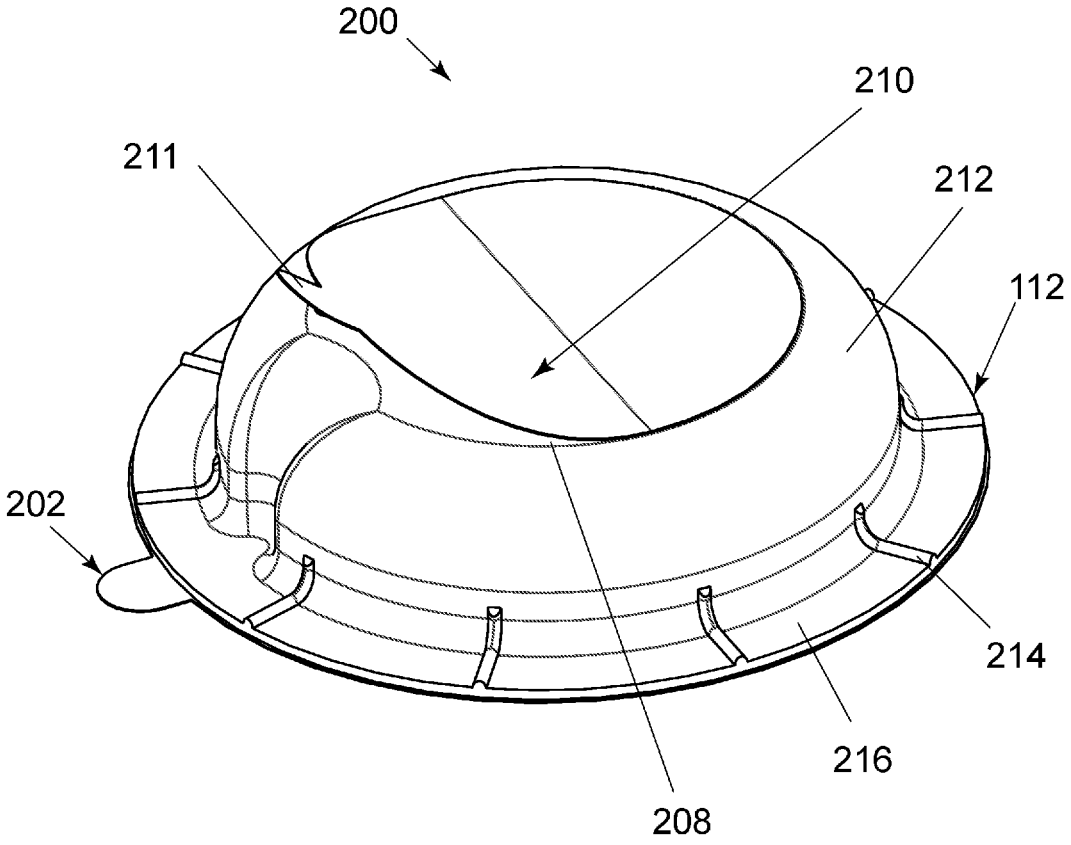
FIG. 12 illustrates a bottom isometric view of the capsule assembly of FIG. 11.

FIGS. 11-12 illustrate an exemplary capsule assembly 200. As shown in FIG. 11, assembly 200 may include the capsule 112 with the capsule interlock 144, as described above. Assembly 200 may have an upper label 202 that may depict the type or flavor of smoking product and that may include a tab 203 to facilitate removal. As shown in FIG. 12, assembly 200 may include a lower label 210 with capsule information such as manufacturing and expiration dates and may include a tab 211 to facilitate removal. Upper label 202 may be removable and lower label 210 may be removable or permanent.

Referring back to FIG. 11, the assembly 200 may have a foil cover 206. The foil cover 206 may be configured to retain the smoking product in the capsule 112 and transfer of heat from the heat source to the smoking product. The foil cover 206 may be made of aluminum. The foil cover 206 may include perforations, e.g., to allow oxygen to enter the capsule 112 to facilitate burning of the smoking product. The foil cover 206 may be configured to form an air gap between the foil cover 206 and the smoking product, e.g., to space the smoking product from the heat source to reduce overheating or unwanted burning of the smoking product.

The assembly 200 may include capsule identification. The assembly 200 may include a machine readable code 204 (e.g., a serialized barcode) as shown in FIG. 11. Alternatively or in addition, the assembly 200 may include a radio frequency identification (RFID) tag 208 as identified in FIG. 12 and that may be detected by an RFID sensor, as discussed below. The capsule information may include a smoking product type, a manufacturer, and an expiration date associated with the particular smoking product in the capsule 112.

Capsule 112 may also include an angled or curved profile 212, e.g., to facilitate airflow between the capsule 112 and the cavity member 114. Capsule 112 may also include brackets 214 to provide a gap 216 between the brackets 214 and relative to an upper surface of the cavity member 114. These may facilitate airflow relative to and ease removal from the cavity member 114.

Figure 13:
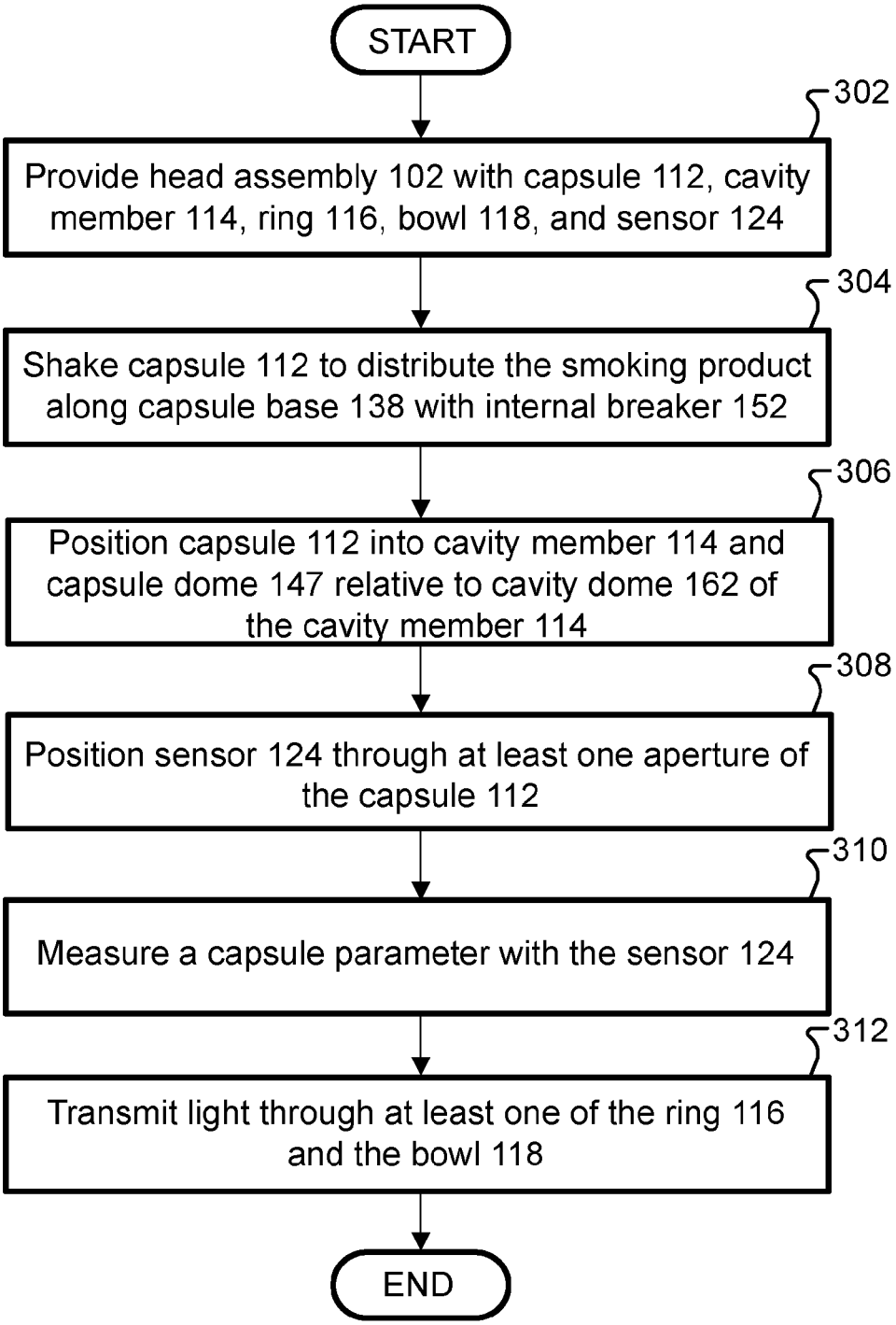
FIG. 13 illustrates an exemplary method of the present disclosure.

FIG. 13 illustrates a method 300 of using a hookah system 100. At block 302, the method 300 may include providing the head assembly 102 with the capsule 112, the cavity member 114, the ring 116, the bowl 118, and the sensor 124. At block 304, the method may include shaking the capsule 112, before positioning the capsule 112 in the cavity member 114, to distribute the smoking product along the capsule base 138 with the internal breaker 152 on at least one of the capsule base 138 and the capsule sidewall 140. At block 306, the method may further include positioning the capsule 112 into at least a portion of the cavity member 114 and positioning the capsule dome 147 relative to a cavity dome 162 of the cavity member 114 to provide a fluid connection therebetween. The method may also include positioning the sensor 124 through at least one aperture of the capsule base 138 at block 308 and measuring a capsule parameter with the sensor 124 at block 310. At block 312, the method may include transmitting light through at least one of the ring 116 and the bowl 118, e.g., after detecting the capsule identification and in response to at least one of capsule and environmental parameters, as discussed above.

It will be appreciated that the aforementioned method and devices may be modified to have some components and steps removed, or may have additional components and steps added, all of which are deemed to be within the spirit of the present disclosure. None of the components or steps herein are essential elements nor is their interdependency required. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

What is claimed is:

1. A hookah system for a smoking product, comprising:

a head assembly including a cavity member having a cavity base with a cavity dome extending upwardly from the cavity base and a shaft extending downwardly from the cavity base and defining a passage about a central axis, a cavity sidewall extending upwardly from the cavity base and having a curved portion including a cavity interlock with a round surface configured to be positioned in at least a corresponding round surface of a corresponding member, the curved portion being configured to facilitate airflow between the cavity member and the corresponding member, and a cavity shelf extending outwardly from the cavity sidewall;

a bowl having a bowl base and a bowl sidewall extending from the bowl base, the bowl base having an aperture configured to engage the shaft; and a ring configured to be positioned between the cavity member and the bowl.

2. The system of claim 1, wherein the corresponding member is associated with a capsule having a capsule base, a capsule sidewall extending upwardly from the capsule base and having the capsule interlock, and a capsule shelf extending outwardly from the capsule sidewall.

3. The system of claim 2, wherein the capsule includes an internal breaker extending inwardly in a radial direction from the capsule sidewall.

4. The system of claim 2, wherein the capsule includes a capsule dome extending from the capsule base and including capsule dome holes.

5. The system of claim 4, wherein the capsule dome is configured to receive the cavity dome of the cavity member and each of the capsule dome holes is configured to fluidly connect with a respective one of the cavity dome holes of the cavity dome.

6. The system of claim 2, wherein the capsule base includes at least one aperture configured to receive a sensor.

7. The system of claim 2, wherein the capsule includes at least one of a machine readable code and a radio frequency identification tag.

8. The system of claim 1, wherein the ring includes an upwardly extending rib, a downwardly extending rib, and a sidewall therebetween, and further comprising one or more lights configured to transmit light through the sidewall of ring.

9. The system of claim 1, further comprising:

a hookah capsule being the corresponding member, the hookah capsule including a capsule base;

a capsule sidewall extending upwardly from the capsule base; and a capsule shelf extending outwardly from the capsule sidewall.

10. The system of claim 9, wherein the capsule includes a foil cover with perforations and the foil cover is secured to the capsule shelf.

11. The system of claim 9, wherein the capsule includes an internal breaker extending inwardly in a radial direction from the capsule sidewall.

12. The system of claim 9, further comprising a capsule dome extending from the capsule base, wherein the capsule dome includes capsule dome holes.

13. The system of claim 12, wherein the capsule base includes a capsule dome configured to receive the cavity dome of a corresponding cavity member, and the capsule dome includes capsule dome holes, and each of the capsule dome holes is configured to fluidly connect with a respective one of the cavity dome holes of the cavity dome of the corresponding cavity member.

14. The system of claim 9, wherein the capsule base includes at least one aperture configured to receive a sensor.

15. The system of claim 9, wherein the capsule includes at least one of a machine readable code and a radio frequency identification tag.

* * * * *